United States Patent [19]

Slautterback

[11] Patent Number: 4,970,985

[45] Date of Patent: Nov. 20, 1990

[54] APPARATUS FOR TAILING REDUCTION IN HOT-MELT DISPENSING OF DROPLET PATTERNS

[75] Inventor: Fred A. Slautterback, Carmel Valley, Calif.

[73] Assignee: Slautterback Corporation, Monterey, Calif.

[21] Appl. No.: 346,146

[22] Filed: May 1, 1989

[51] Int. Cl.[5] ..... B05C 5/04

[52] U.S. Cl. ..... 118/300; 156/578; 239/8; 239/296; 239/300

[58] Field of Search ..... 156/295, 291, 578, 356; 118/300, 323, 313; 239/292, 298, 290, 296, 300, 8; 222/566

[56] References Cited

U.S. PATENT DOCUMENTS

| | | | |
|---|---|---|---|
| 3,348,520 | 10/1967 | Lockwood | 156/359 X |
| 3,661,679 | 5/1972 | Law | 156/578 X |
| 4,031,854 | 6/1977 | Sprague, Jr. | 118/641 |
| 4,280,864 | 7/1981 | Bromberg | 156/500 |
| 4,642,158 | 2/1987 | Steinel et al. | 156/578 X |
| 4,785,996 | 11/1988 | Ziecker et al. | 239/298 |
| 4,815,660 | 3/1989 | Boger | 156/578 X |
| 4,844,003 | 7/1989 | Slautterback et al. | 239/298 X |

*Primary Examiner*—Robert A. Dawson
*Assistant Examiner*—Jeff H. Aftergut
*Attorney, Agent, or Firm*—Thomas Schneck

[57] ABSTRACT

An apparatus and method for reducing hot-melt adhesive tailing in an adhesive pattern wherein material squirted or extruded from a nozzle in a desired pattern experiences tailing. The adhesive is released from a material passageway along a trajectory, with an array of gas passageways radially and symmetrically surrounding the material passageway in an inclined manner. A gradual flow of gas from the gas passageways is directed to strike the adhesive tailing, thereby urging the tailing to follow the intended deposition trajectory. Like the adhesive, the release of gas may be valved or, alternatively, the gas may be a steady flow.

14 Claims, 1 Drawing Sheet

APPARATUS FOR TAILING REDUCTION IN HOT-MELT DISPENSING OF DROPLET PATTERNS

TECHNICAL FIELD

The present invention relates to hot-melt adhesive fluid squirting or extruding applicators and particularly to such applicators for bonding a liner to a bottle closure cap.

BACKGROUND ART

Snap-fit caps or caps threaded onto glass and plastic bottles and the like are ubiquitous in the bottling industry. Commonly, a closure cap is made of a plastic material and a resilient liner for providing a tight seal. The closure cap includes a planar crown and a depending skirt, with the liner being adhered to the planar crown.

Devices for adhesively attaching the sealing liner to the closure cap are known. U.S. Pat. No. 4,280,864 to Bromberg teaches an apparatus and method for lining caps. Such devices are used on automated assembly lines to apply adhesive to the inside surface of the closure cap, whereafter the sealing liner is brought into pressure contact with the adhesive. The assembled container closure is then releasably fitted to a plastic bottle or the like.

Direct depositing of adhesive onto an interior surface as taught by Bromberg, and squirting of adhesive are two methods of applying a desired pattern onto a closure cap. Both of these methods, however, are susceptible to adhesive tailing resulting from the viscosity of the adhesive which exhibits itself as the cohesion between the molecules of the material extruded from a nozzle and the material remaining at the outlet of the nozzle. Cohesion causes an elongation, commonly referred to as tailing or stringing, after each application of material. A second problem related to tailing is adhesion by the contact of the applied material to a metallic nozzle. Like cohesion, nozzle adhesion causes an elongation of the material.

In most instances tailing is not harmful. Where a dot of adhesive is the desired pattern for bonding a sealing liner to a closure cap, viscous forces merely give the dot a droplet form. However, in automated assembly line use, a nozzle must repeatedly and rapidly extrude the desired pattern. Over a period of time the tailing after some extrusions is excessive, resulting in a filament of adhesive. The filament is referred to as "angel hair" and is undesirable. Filaments which remain attached at one end to the desired pattern of adhesive may drape across the container-engaging threads of the closure cap, causing problems at some later time. Filaments which break away from the desired pattern entirely may become airborne and uncontrolled.

It is an object of the present invention to provide an apparatus and method to protect against the detrimental effects of a nozzle's tailing at the cutoff of adhesive from the nozzle.

DISCLOSURE OF THE INVENTION

The above object has been met with a hot-melt applicator nozzle for a squirting or extruding dispenser featuring a counterbalance against the attractive forces characteristic of viscous materials which lead to adhesive tailing. The counterbalancing of forces makes even excessive tailing a tolerable condition by terminating the tailing at the intended surface.

The apparatus includes a squirting or extruding applicator having a material passageway therethrough with surrounding gas passageways. At a first end of the material passageway is a source of hot-melt adhesive. The opposite end of the material passageway is a material outlet at a face of the applicator, from which gas also flows. Typically, the material outlet is in a nozzle of the applicator. The nozzle is directed at a surface and a valve is actuated to permit adhesive flow for extrusion in a desired pattern from the material outlet.

A plurality of gas passageways are symmetrically arranged about the material passageway and are inclined relative to the material outlet. Upon cutoff of material flow, the molecules of the adhesive which has been extruded from the outlet are cohesively attracted to the molecules of the adhesive remaining in the nozzle and are attracted to the nozzle itself. The extruded adhesive, therefore, experiences at least some degree of tailing. The gas flow from the array of gas passageways, however, guides the tail portion of adhesive so as to follow the lead portion of adhesive. The extrusion of adhesive consequently accumulates at the surface to be bonded so that the tailing terminates at the desired location.

While the present invention may be used in other applications, the bonding of a sealing liner to a closure cap is an application which particularly benefits from the invention. Adhesive is extruded in a desired pattern from the material outlet toward a closure cap. The flow of gas is directed to strike any tailing which may have been produced by such extrusion and urges the tailing to follow the desired pattern of adhesive onto the closure cap. The sealing liner is then brought into pressure contact with the adhesive. An advantage of the present invention is that even excessive tailing which leads to formation of a filament, or "angel hair", is tolerated. The relevant attractive forces can be minimized by the choice of adhesives and the choice of nozzle material, but the attractive forces cannot be eliminated. This is recognized, and the present invention is a focus not on minimizing attractive forces but instead on compensating for those forces.

BEST MODE FOR CARRYING OUT THE INVENTION

Figure 1:
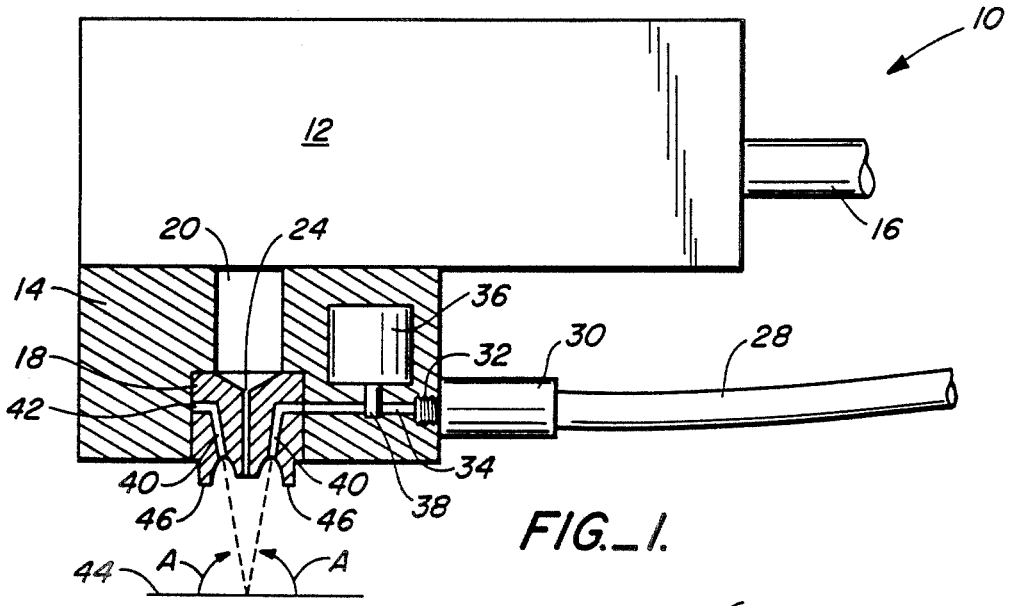
FIG. 1 is a side, partial sectional view of an applicator in accord with the present invention.
Figure 2:
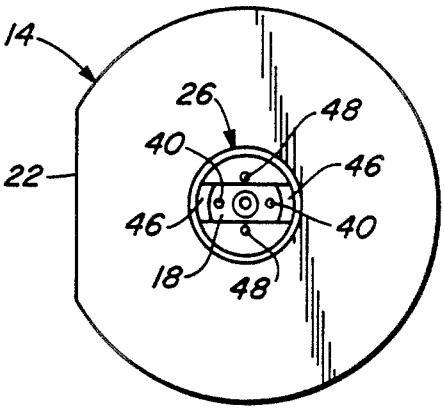
FIG. 2 is a bottom view of the nozzle manifold of FIG. 1.

With reference to FIGS. 1 and 2, an applicator for hot-melt adhesive is shown as including a heater block 12 and a nozzle manifold 14. The heater block 12 receives a stream of adhesive from a hose 16 which originates at a source of pressurized adhesive, not shown. The source may include a valve which circulates on and off to provide the periodic application of adhesive needed in automated assembly line use. However, preferably the heater block 12 includes a valving assembly.

The heater block 12 contains a pair of 500 watt heaters, not shown, which maintain hot-melt adhesive in a molten condition during passage through the applicator 10. The nozzle manifold 14 is in heat-conducting relationship with the heater block 12. The nozzle manifold is made of a metal, such as brass, having a high thermal conductivity. In order to maintain adhesive in a less viscous melted condition which may be dispensed at a low pressure, it is necessary to minimize any cooling during passage of the adhesive through the applicator 10.

The nozzle manifold 14 includes a nozzle 18 that is in fluid communication with the heater block 12 via a throughbore 20 in the nozzle manifold. The nozzle manifold has a truncated cylindrical configuration, with a flat side 22 which is flush with the forward surface of the heater block. The nozzle 20 is axially disposed within the nozzle manifold and includes a central material passageway 24.

A stream of hot-melt adhesive from the heated hose 16 progresses through the heater block 12 and into the throughbore 20 of the nozzle manifold whereupon the adhesive is extruded from the outlet of the material passageway 24. In this manner, adhesive is extruded from the face 26 of the applicator. As will be described more fully below, for purposes of bonding a sealing liner to a closure cap for a container, the desired pattern of adhesive deposition is merely a dot of adhesive. However, the applicator 10 is equally capable of depositing an elongated bead for such applications as the sealing of corrugated boxes.

A gas hose 28 is attached to the nozzle manifold 14 by a fitting 30 having an externally threaded portion 32 which is received in a threaded end of a gas inlet 34. Optionally, the nozzle manifold 14 may include a solenoid 36 which is actuated to retract a solenoid rod 38 to selectively permit gas flow from the hose 28 to an array of gas passageways 40 in the nozzle 18.

Each gas passageway 40 is in fluid communication with the inlet 34 via an annular gap 42. As best seen in FIG. 1, the gas passageways 40 are at an angle to a plane 44 parallel to the face of the applicator 10. This angle is indicated by arrows A and is typically 80°. Thus, the gas passageways 40 are inclined at an angle of 10° relative to the material passageway 24. The exact inclination is not critical, but should be within the range of 1° to 20°.

Referring again to FIGS. 1 and 2, only two of the gas passageways 40 are within the nozzle 18. Each of the two gas passageways 40 through the nozzle is protected from foreign debris by a guard 46 projecting from the face 26 of the nozzle manifold. Third and fourth gas passageways 48 are on opposed sides of the material passageway 24 and are each 90° from the nozzle gas passageways 40, but preferably the gas passageways 40 and 48 are identical in structure and in function.

Figure 3:
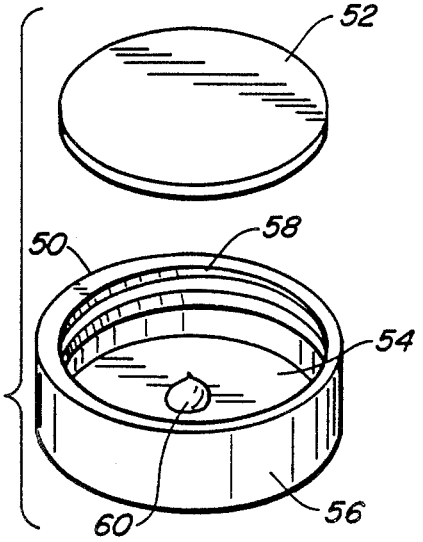
FIG. 3 is an exploded view of a container closure.

A container closure is shown in FIG. 3 to include a closure cap 50 and a sealing liner 52. The closure cap includes a planar crown 54 and a depending skirt 56 having container-engaging threads 58. The closure cap 50 is typically made of plastic, whereas the sealing liner 52 may be made of cork, paper or plastic resinous material such as polyolefins. The sealing liner is disk shaped and is designed to provide a tight seal when the container closure is threaded onto the neck of a bottle or other container.

Figure 4A:
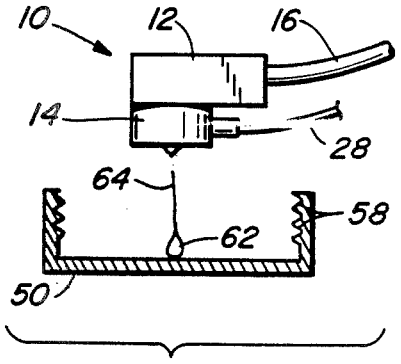
FIGS. 4A and 4B are operational side views of the applicator of FIG. 1.
Figure 4B:
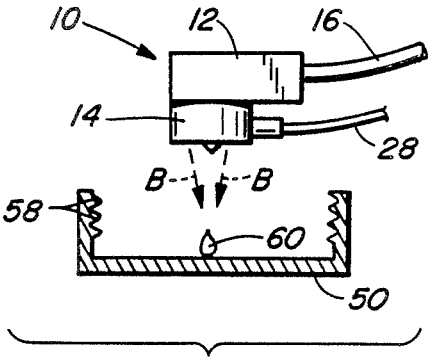

In bonding the sealing liner 52 to the closure cap 50, a dot 60 of adhesive is deposited into the recess formed by inverting the closure cap, whereafter the sealing liner 52 is pressed into the closure cap. The method of depositing the dot 60 of adhesive is shown in FIGS. 4A and 4B. In use on an automated assembly line, closure caps are serially delivered to the area directly below the applicator 10 Adhesive enters from the heated hose 16 into the heater block 12 for extrusion from the nozzle manifold 14. Ideally, extrusion from the nozzle manifold is in the dot form shown in FIG. 3. However, in practice attractive forces cause an elongation of the extruded adhesive. This elongation is shown in FIG. 4A to include a portion 62 of adhesive in the desired pattern and a second portion 64 which is adhesive tailing. The attractive forces which cause the elongation include cohesion and adhesion. The cohesion is the force among the molecules of extruded adhesive and adhesive remaining in the nozzle of the nozzle manifold 14. The adhesion results from attraction of the viscous adhesive to the nozzle manifold.

Excessive tailing causes formation of a filament, known as "angel hair". Angel hair will sometimes drape itself across the container-engaging threads 58 of the closure cap 50, thereby creating potential problems when the closure cap is later threaded onto a container. However, the flow of gas from the hose 28 provides a force which counteracts the attractive forces. The gas flow is shown by arrows B in FIG. 4B. As noted above, the gas passageways through the nozzle manifold 14 are inclined relative to the flow of adhesive. Upon cutoff of the flow of adhesive, the gas directed to strike the adhesive tailing 64 so as to urge the tailing to follow the desired pattern 62 of the adhesive.

Therefore, a counterbalancing of forces takes place. The flow of gas from the nozzle manifold 14 is not intended to break up the adhesive, but to the contrary provides trajectory definition to the adhesive by directing any adhesive tailing to follow the defined path of the lead portion 62 of adhesive. Because the gas flow should not affect the lead portion, the flow rate should be low. A flow rate of one cubic foot/hour is typical, but the range should be within 0.1 to 10 cubic feet/hour.

Referring to FIG. 1, depending upon the viscosity of the type of adhesive it may be beneficial to valve the gas flow. A particularly viscous material may require high rates of flow to compensate for the attractive forces experienced by the material at nozzle cutoff. However, such high rates of adhesive flow may cause undesirable attenuation and stretching of the hot-melt adhesive. Therefore, solenoid 36 may be selectively actuated to provide blockage of the gas inlet 34 by the solenoid rod 38. For example, after nozzle cutoff the solenoid rod may be retracted momentarily to permit a "puff" of gas so as to push adhesive tailing along the intended path.

While the present invention has been illustrated and explained with reference to assembly of a container closure, the hot-melt applicator 10 may be used for other purposes as well. For example, in the dispensing of elongated beads of adhesive, a gas flow rate sufficiently minor so as not to affect bead formation may be used to control adhesive tailing after nozzle cutoff. Additionally, in place of the nozzle manifold 14 shown in FIG. 2, all of the gas passageways 40 and 48 may be bores within the nozzle manifold rather than a nozzle.

I claim:

1. An apparatus for applying adhesive to a substrate comprising, nozzle outlet means for extruding an airborne, generally vertical path of adhesive droplets having an adhesive tailing at a substrate, and guiding means for urging said tailing to follow the vertical path to said substrate, said guiding means including a gas passageway directed with respect to said nozzle outlet means to strike said tailing, thereby providing a force for said urging of said tailing.

2. The apparatus of claim 1 wherein said gas passageway is a first gas passageway, said guiding means including a plurality of other gas passageways.

3. An apparatus for bonding a first substrate to a second substrate comprising, means for dispensing droplets of fluid adhesive in an airborne, generally linear trajectory for bonding said first and second substrates, said dispensing means including an applicator having first internal walls defining a material passageway therethrough, said material passageway having a receiving end and a material outlet, and means, operatively associated with yet functionally distinct from said dispensing means, for guiding airborne adhesive tailing in a manner to merge with said adhesive in the generally linear trajectory, said guiding means including second internal walls in said applicator to define a gas passageway, said gas passageway having a gas ingress end and having a gas egress end in proximity to said material outlet.

4. The apparatus of claim 3 wherein said guiding means includes a source of gas in fluid communication with said ingress end of said gas passageways.

5. The apparatus of claim 3 wherein said guiding means includes an array of gas passageways symmetrically arranged about said material outlet.

6. The apparatus of claim 5 wherein said gas passageways are each inclined relative to said material outlet.

7. The apparatus of claim 5 wherein said gas passageways are each at an angle in the range between 1° and 20°, relative to the material passageway.

8. The apparatus of claim 5 wherein said dispensing means includes a nozzle insert frictionally received within said material outlet.

9. An apparatus for applying adhesive onto a deposition surface comprising, valving means for regulating a flow of liquid adhesive from a source of adhesive to a nozzle for forming droplets, and a nozzle having a face spaced apart from said deposition surface and having a material passageway in fluid communication with said valving means to receive adhesive therefrom, said material passageway having a material outlet at said face for the dispensing of on-the-fly adhesive droplets having an adhesive tailing along a defined, generally linear path toward said deposition surface, said nozzle further having a gas passageway having a gas outlet at said face, said gas outlet being in spaced relation to said material outlet, said gas passageway being radially aligned relative to said material passageway to direct a lfow of gas so as to urge said on-the-fly adhesive tailing along said defined, generally linear path onto said deposition surface.

10. The apparatus of claim 8 wherein said applicator includes an array of gas passageways symmetrically arranged about said material passageway.

11. The apparatus of claim 10 wherein each gas passageway has a longitudinal section, said longitudinal sections converging as said gas passageways near said face, each longitudinal section being at an angle in the range of 1° to 10° relative to said material passageway.

12. The apparatus of claim 8 further comprising a source of pressurized gas flow having a rate within the range of 0.1 to 10 cubic feet/hour.

13. The apparatus of claim 10 wherein said gas passageways are four in number.

14. The apparatus of claim 8 wherein said material passageway is at a generally right angle relative to said deposition surface.

* * * * *

UNITED STATES PATENT AND TRADEMARK OFFICE

CERTIFICATE OF CORRECTION

PATENT NO. : 4,970,985

DATED : November 20, 1990

INVENTOR(S) : Fred A. Slautterback

It is certified that error appears in the above-identified patent and that said Letters Patent is hereby corrected as shown below:

Column 4, line 26, "the gas directed" should read
- - the gas is directed - - .

Claim 9, column 6, line 18, "a lfow of gas" should read
- - a flow of gas - - .

Signed and Sealed this

Twenty-first Day of April, 1992

*Attest:*

HARRY F. MANBECK, JR.

*Attesting Officer*

*Commissioner of Patents and Trademarks*